United States Patent [19]

Hovhannessian

[11] 4,157,592

[45] Jun. 12, 1979

[54] ADJUSTABLE SUN HAT

[76] Inventor: Karnig Hovhannessian, 5154 Romaine St., Los Angeles, Calif. 90029

[21] Appl. No.: 851,157

[22] Filed: Nov. 14, 1977

Related U.S. Application Data

[63] Continuation-in-part of Ser. No. 631,533, Nov. 13, 1975, Pat. No. 4,057,855.

[51] Int. Cl.[2] ..... A42B 1/18; A42B 1/20

[52] U.S. Cl. ..... 2/177; 2/182.6; 2/421

[58] Field of Search ..... 2/177, 182.6, 175, 171, 2/180, 8, 182.1, 421

[56] References Cited

U.S. PATENT DOCUMENTS

| | | | |
|---|---|---|---|
| 2,140,647 | 12/1938 | Myers | 2/177 |
| 2,252,902 | 8/1941 | Subira et al. | 2/182.6 |
| 2,700,158 | 1/1955 | Larsen | 2/8 |
| 3,585,643 | 6/1971 | Ryan | 2/177 |
| 3,852,821 | 12/1974 | Mickel | 2/421 X |

FOREIGN PATENT DOCUMENTS

| | | | |
|---|---|---|---|
| 485640 | 10/1953 | Italy | 2/177 |

*Primary Examiner*—Peter Nerbun
*Attorney, Agent, or Firm*—Lyon & Lyon

[57] ABSTRACT

Disclosed herein is an adjustable hat for protecting one from the rays of the sun. The hat is comprised of a collapsible body portion adjustably mounted on an upper support band and a head and chin band assembly. The head and chin band assembly includes a pair of upper headbands which are preferably integrally formed with an adjustable chin strap. The head and chin band assembly is in turn adjustably mounted on the upper support band such that the hat can be adjusted to any desired angular position on the wearer's head to block the sun's rays.

5 Claims, 5 Drawing Figures

ADJUSTABLE SUN HAT

This application is a continuation-in-part of the parent application, Ser. No. 631,533, on an ADJUSTABLE SUN HAT, filed Nov. 13, 1975 now Pat. No. 4,057,855.

BACKGROUND OF THE INVENTION

Various types of hats and assorted head gear have heretofore been used by countless numbers of individuals to protect themselves from the sun. Typically such devices are quite large and cumbersome and have limited flexibility. To adjust the hat to a change in the orientation of the person with respect to the sun's rays, the hat must be tilted on the wearer's head and this can only be done to a limited extent. Some devices such as that taught in U.S. Pat. No. 3,585,643, do include means for adjusting the orientation of the hat on the wearer's head, however, the means used therein is still somewhat limited due to the necessity of the hat being anchored to the wearer's hair and, as with conventional sun hats, it is quite cumbersome. Additionally, a sun hat should not only be highly flexible so that it can be readily adjusted to block the sun regardless of the relative positioning of the sun with respect to the wearer, but it should be attractive as well. Accordingly, the present invention provides a sun hat which is highly flexible with respect to its angular orientation on the wearer's head, is readily collapsible for carrying and also quite attractive.

SUMMARY OF THE INVENTION

Briefly, the present invention comprises a sun hat having a collapsible shade providing a body portion and upper band which supports the body portion and a chin and headband assembly which is adapted to fit about the wearer's head and is secured to the support band. The body portion of the hat is adjustably mounted on the support band which in turn is pivotally secured to the chin and headband assembly such that the body portion of the hat can be positioned in any desired angular orientation on the wearer's head to shield the wearer from the sun regardless of the inclination of the sun to the wearer.

It is the principal object of the present invention to provide a readily adjustable sun hat which can be pivoted to any desired position on the wearer's head to shield the wearer from the sun's rays regardless of the inclination of the sun to the wearer.

It is another object of the present invention to provide a sun hat which is both readily adjustable on the wearer's head and easily collapsible to facilitate carrying.

It is a still further object of the present invention to provide a decorative sun hat for shielding the wearer from the rays of the sun.

These and other objects and advantages of the present invention will become apparent from the following detailed description taken in conjunction with the accompanying drawings.

DESCRIPTION OF THE PREFERRED EMBODIMENT

Figure 1:
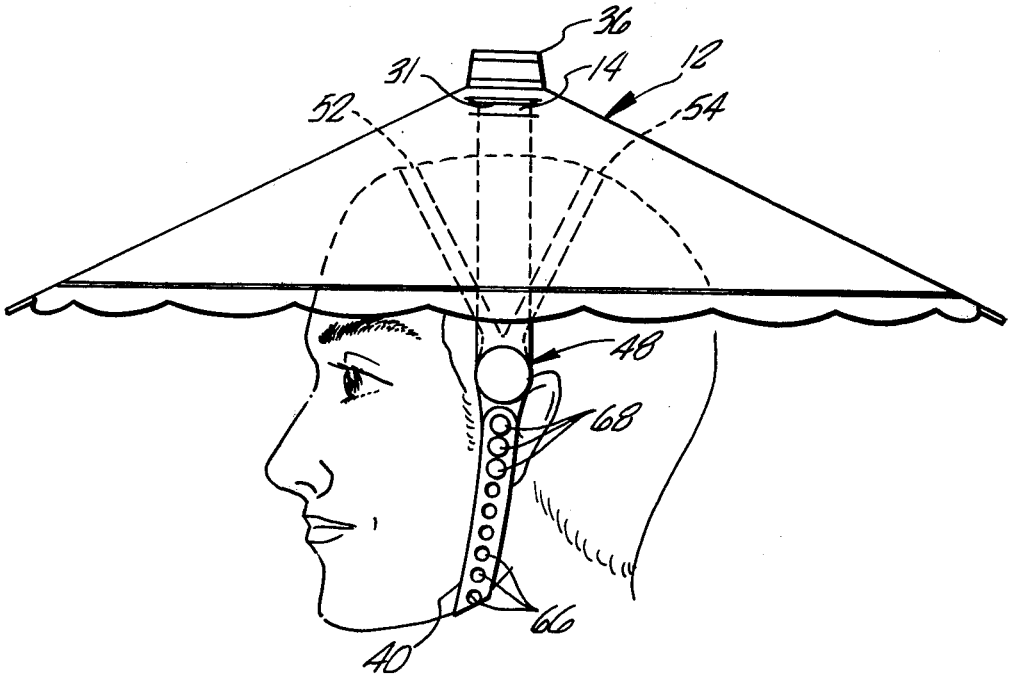
FIG. 1 is a side elevation of the sun hat being worn by a person in the upright position.
Figure 2:
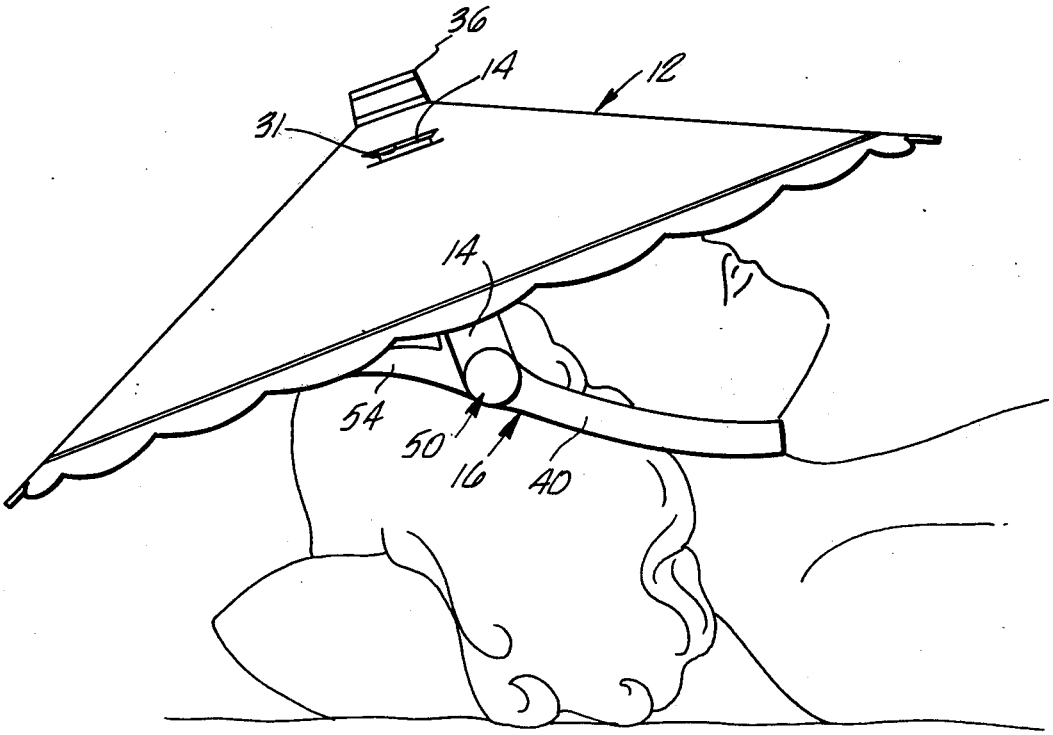
FIG. 2 is a side elevation of the sun hat being worn by a person in a reclining position.
Figure 3:
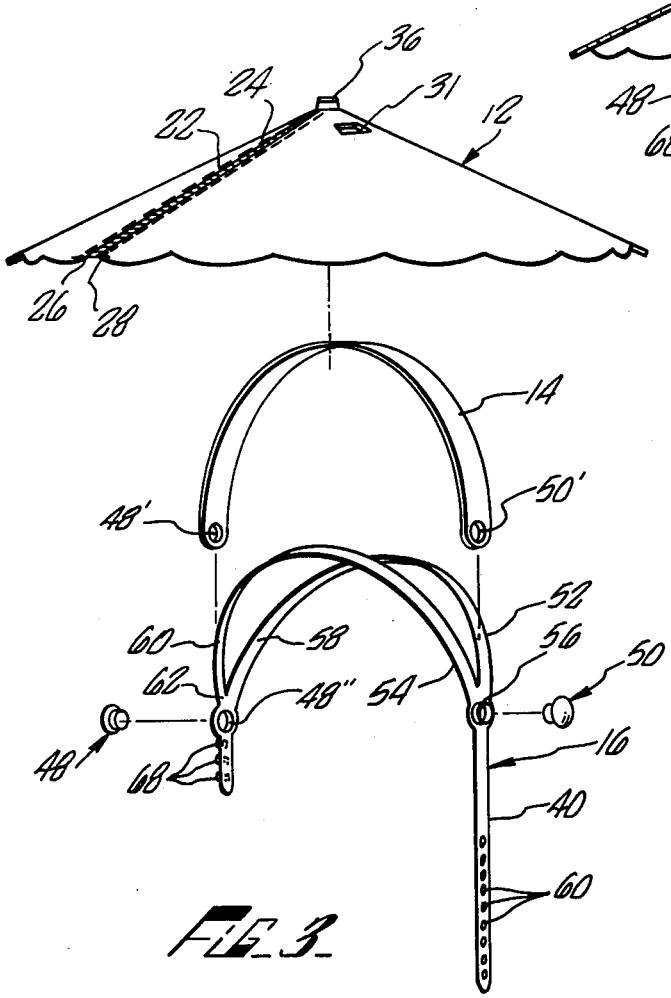
FIG. 3 is an exploded view of the sun hat illustrating the various components thereof.

Referring now in detail to the drawings, the sun hat 10 is comprised of a collapsible body portion 12, an upper support band 14 and a head and chin band assembly 16 which is adapted to fit about the wearer's head and chin as seen in FIGS. 1 and 2. The body portion of the hat can be constructed of any number of shape-retaining pliable materials or combinations thereof to render the body portion collapsible for carrying. By way of example, the body portion illustrated in the drawings could be constructed of an inner layer of pliable material 18 such as a polymeric foam material and an outer layer of polymeric sheet material 20 to provide a decorative appearance to the body portion. To facilitate collapsing of the body portion after removing the same from the head and chin band assembly 16, the body portion is open along a radius 22 thereof (see FIG. 3) and a fastening member 24 such as a zipper is disposed along the opening for joining the open ends to define a conically shaped body portion. A pair of strips of material 26 and 28 are sandwiched between the inner and outer layers of the body portion adjacent said opening for supporting the zipper or other fastening means.

Figure 4:
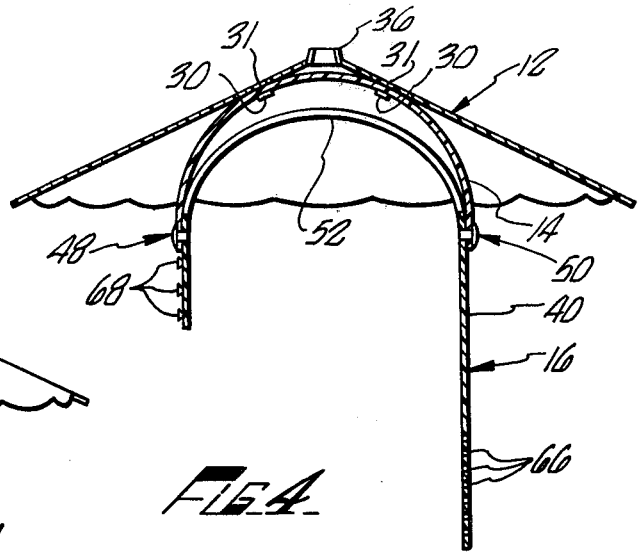
FIG. 4 is a sectional frontal view of the sun hat.

The body portion 12 of sun hat 10 is provided with a pair of brackets 30 and 32 disposed on the underside thereof on either side of a decorative raised center portion 36. These brackets can be easily formed by slitting the hat at locations 31 and folding under portions of the hat adjacent each side of the slits for forming small flaps which are then in turn provided with slits to define the brackets. With this construction, the brackets are integral with the body portion of the sun hat. Of course, separate brackets could also be used which could be affixed to the underside of the body portion in any desired manner. The upper support band 14 extends through brackets 30 and 32 as best seen in FIG. 4 so that the body portion 12 of the sun hat can slide along band 14.

The head and chin band assembly 16 is comprised of a flexible chin band 40 and a pair of upper headbands 44 and 46, all of which are preferably constructed of a soft, lightweight plastic material. The upper support band 14 is pivotally secured at its lower extended ends to the head and chin band assembly 16 by suitable fastening members 48 and 50 which extend through apertures 48' and 50' in the lower end of support band 14 and aligned apertures 48'' and 50'' in the head and chin band assembly 16 and allow the head and chin band assembly to pivot with respect to the upper support band 14 about a first axis running through members 48 and 50. The headbands 44 and 46 extend over the wearer's head and are preferably integrally joined at ends 52 and 54 thereof with the chin band 40 at 56. The other ends 58 and 60 of the headbands are preferably integrally joined at 62 with a strap member 64 extending therefrom and defining a portion of the chin band in a manner to be described. Chin band 40 is provided with a plurality of apertures 66 therein which are adapted to receive protuberance 68 extending from strap 64 to adjustably secure the chin strap about the wearer's chin so that the head and chin band assembly 16 is adjustable to fit a wide range of wearer's head sizes.

Figure 5:
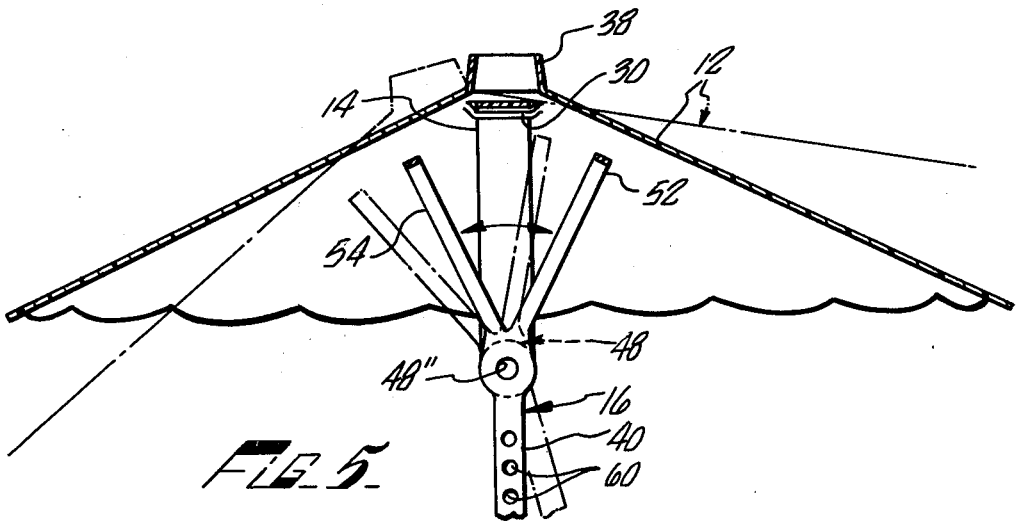
FIG. 5 is a sectional side view of the sun hat illustrating the pivotal motion of the chin and head band assembly in phantom lines.

The aforesaid chin and headband assembly provides a high degree of flexibility in the sun hat in that the body portion 12 can be slid to either side of the wearer's head by virtue of the slidable mounting of the body portion 12 of the sun hat on the upper support band 14 and can be pivoted forwardly and rearwardly on the wearer's head by virtue of the upper support band 14 being pivotally secured to the chin and headband assembly 16 as illustrated in phantom lines in FIG. 5. Thus the flexibility in the sun hat 10 stems from the body portion of the hat being pivotally moveable about a first axis running through the fastening members 48 and 50 and, as the body portion of 12 of the sun hat is slided along the support band 14, it is rotatably moved about a second axis which is perpendicularly disposed with respect to the aforesaid first axis running through the fastening members 48 and 50. In addition to such flexibility which allows the wearer to position the body portion of the hat in any desired angular orientation on his head regardless of his body position, the sun hat 10 can be easily disassembled for carrying by simply sliding the upper support band 14 through brackets 30 and 32 and undoing the zipper or other fastening member 24. The body portion 12 of the hat can then be easily rolled into a compact tubular configuration for carrying.

Various changes and modifications may be made in carrying out the present invention without departing from the spirit and scope thereof. Insofar as these changes and modifications are within the purview of the appended claims they are to be considered as part of the present invention.

I claim:

1. An adjustable sun hat comprising an integrally formed head and chin band assembly having a first band portion adapted to extend about the wearer's chin, second and third band portions adapted to extend about the upper portion of the wearer's head and being joined together at the extended ends thereof, a support band pivotally secured to said head and chin band assembly adjacent at the points of juncture of said second and third bands for movement of said support band about a first axis, a collapsible body portion slidably mounted on said support band for pivotal movement of said body portion about a second axis, said second axis being substantially perpendicular to said first axis whereby said body portion of said hat can be positioned in any desired angular orientation on the wearer's head to block the sun's rays.

2. The combination of claim 1 wherein said first band portion extends approximately from one of said points of juncture and including a fourth band portion extending approximately from the other of said points of juncture, said first and fourth band portions having means thereon for locking said first band about the wearer's chin.

3. The combination of claim 1 wherein said collapsible body portion of said sun hat has a radially extending seam therein and fastening means disposed along said seam on both sides thereof for closing said seam and defining a conically shaped collapsible body portion.

4. An adjustable sun hat comprising a head and chin band assembly including a first band portion adapted to extend about the wearer's chin and a second band portion adapted to extend over the upper portion of the wearer's head; a support band pivotally secured to said head and chin band assembly for movement of said support band about a first axis, a body portion slidably mounted on said support band for rotational movement of said body portion about a second axis, said second axis being substantially perpendicular to said axis whereby said body portion of said hat can be positioned in any desired angular orientation on the wearer's head to block the sun's rays.

5. The combination of claim 4 including a third band portion adapted to extend over the upper portion of the wearer's head, said third band portion being integrally formed with said first and second portions such that said first band portion extends approximately from one of the points of juncture of said second and third band portions and a fourth band portion extends approximately from the other point of juncture of said second and third band portions and means for locking said first band portion to said fourth band portion about the wearer's chin.

* * * * *